US010604990B2

(12) United States Patent
Kendall

(10) Patent No.: US 10,604,990 B2
(45) Date of Patent: Mar. 31, 2020

(54) PASSIVE DOOR BOLT ASSEMBLY

(71) Applicant: Endura Products, Inc., Colfax, NC (US)

(72) Inventor: Adam Kendall, Greensboro, NC (US)

(73) Assignee: Endura Products, LLC, Colfax, NC (US)

( * ) Notice: Subject to any disclaimer, the term of this patent is extended or adjusted under 35 U.S.C. 154(b) by 674 days.

(21) Appl. No.: 15/274,036

(22) Filed: Sep. 23, 2016

(65) Prior Publication Data

US 2018/0087311 A1 Mar. 29, 2018

(51) Int. Cl.

| | |
|---|---|
| ***E06B 3/36*** | (2006.01) |
| ***E05C 1/06*** | (2006.01) |
| ***E05C 7/04*** | (2006.01) |
| ***E05C 19/00*** | (2006.01) |
| ***E06B 7/18*** | (2006.01) |
| *E05B 17/20* | (2006.01) |
| *E05B 15/00* | (2006.01) |

(52) U.S. Cl.

CPC ..... *E06B 3/365* (2013.01); *E05C 1/06* (2013.01); *E05C 7/045* (2013.01); *E05C 19/001* (2013.01); *E06B 7/18* (2013.01); *E05B 15/0046* (2013.01); *E05B 17/2015* (2013.01); *E05B 17/2049* (2013.01)

(58) Field of Classification Search

CPC . E05C 7/045; E05C 7/04; E05C 9/185; E05C 9/22; Y10S 292/21; Y10S 292/15; Y10S 292/51; Y10S 292/44; E06B 3/365; Y10T 70/5372

See application file for complete search history.

(56) References Cited

U.S. PATENT DOCUMENTS

| | | | | |
|---|---|---|---|---|
| 618,305 | A | 1/1899 | Weaver | |
| 687,032 | A | 11/1901 | Karrenberg | |
| 826,943 | A | 7/1906 | Kieffer et al. | |
| 1,077,433 | A | 11/1913 | Schlis | |
| 1,207,600 | A * | 12/1916 | Morgan | E05B 63/20 292/181 |
| 2,586,900 | A | 2/1952 | Alderman | |
| 2,610,368 | A | 9/1952 | Tschaepe | |

(Continued)

OTHER PUBLICATIONS

Official Action of Canadian App. No. 2,693,833, dated Oct. 28, 2011, 3 pgs.

(Continued)

*Primary Examiner* — Mark A Williams

(74) *Attorney, Agent, or Firm* — Womble Bond Dickinson (US) LLP

(57) ABSTRACT

A bolt assembly for securing a passive door panel relative to an entryway frame. The bolt assembly comprises an anchoring base fixed relative to the passive door panel. The base has at least one column of spaced apart teeth extending from a side there. The column of spaced apart teeth provides notches between the teeth and adjacent to at least one end of the at least one column. The bolt assembly also has a bolt to slide relative to the base between at least a first position and a second position. The bolt includes a slide having a finger for mating into at least one of the notches in the first position and the second position. The bolt also has a pin attached to the slide for movement therewith. The pin is able to engage the entryway frame when the bolt is in the second position.

21 Claims, 8 Drawing Sheets

(56) References Cited

U.S. PATENT DOCUMENTS

| | | | | |
|---|---|---|---|---|
| 3,211,850 | A | 10/1965 | Toepfer | |
| 3,432,966 | A | 3/1969 | Bordner | |
| 3,487,581 | A | 1/1970 | Elingson, Jr. | |
| 3,638,984 | A | 2/1972 | Davidson | |
| 3,649,060 | A * | 3/1972 | Ruff | E05C 1/04 292/147 |
| 3,656,788 | A | 4/1972 | Emery | |
| 3,788,679 | A | 1/1974 | Banham | |
| 3,788,687 | A | 1/1974 | Zawadzki | |
| 3,806,175 | A | 4/1974 | Van Herpen | |
| 3,888,046 | A | 6/1975 | Meisterheim | |
| 4,052,819 | A | 10/1977 | Beischel et al. | |
| 4,058,332 | A | 11/1977 | DiFazio | |
| 4,428,153 | A | 1/1984 | Klinger et al. | |
| 4,429,493 | A | 2/1984 | St. Aubin | |
| 4,489,968 | A | 12/1984 | Easley | |
| 4,625,457 | A | 12/1986 | Avery | |
| 4,644,696 | A | 2/1987 | Bursk | |
| 4,999,950 | A | 3/1991 | Beske | |
| 5,165,740 | A | 11/1992 | Curnes et al. | |
| 5,197,771 | A | 3/1993 | Kaup | |
| 5,290,077 | A | 3/1994 | Fleming | |
| 5,328,217 | A | 7/1994 | Sanders | |
| 5,335,450 | A | 8/1994 | Procton | |
| 5,350,207 | A | 9/1994 | Sanders | |
| 5,524,942 | A | 6/1996 | Fleming | |
| 5,590,919 | A | 1/1997 | Germano | |
| 5,603,534 | A | 2/1997 | Fuller | |
| 5,782,114 | A | 7/1998 | Zeus | |
| 5,791,700 | A | 8/1998 | Biro | |
| 5,857,291 | A | 1/1999 | Headrick | |
| 5,906,403 | A | 5/1999 | Bestler | |
| 6,009,732 | A | 1/2000 | Haeck et al. | |
| 6,131,966 | A | 10/2000 | Hensley et al. | |
| D438,445 | S | 3/2001 | Monts de Oca | |
| 6,282,929 | B1 | 9/2001 | Eller et al. | |
| 6,457,751 | B1 | 10/2002 | Hartman | |
| 6,491,326 | B1 | 12/2002 | Massey et al. | |
| 6,666,486 | B1 * | 12/2003 | Fleming | E05B 17/2069 292/145 |
| 6,874,830 | B2 | 4/2005 | Bashford | |
| 6,966,585 | B2 | 11/2005 | Egi et al. | |
| 6,971,686 | B2 | 12/2005 | Becken | |
| 7,036,854 | B1 | 5/2006 | Lai | |
| 7,144,053 | B2 | 12/2006 | Bashford | |
| 7,207,608 | B2 | 4/2007 | Monts de Oca | |
| 7,267,379 | B2 | 9/2007 | Rusiana | |
| 7,494,163 | B2 | 2/2009 | Monts de Oca | |
| 7,543,860 | B2 | 6/2009 | Meeks et al. | |
| 7,641,244 | B2 | 1/2010 | Lin | |
| 7,669,902 | B2 | 3/2010 | Orbeta | |
| 7,722,097 | B2 | 5/2010 | Schnarr et al. | |
| 7,735,882 | B2 | 6/2010 | Abdollahzadeh et al. | |
| 7,752,875 | B2 | 7/2010 | Constantinou et al. | |
| 7,900,981 | B2 | 3/2011 | Hirschoff | |
| 7,942,458 | B2 | 5/2011 | Patterson | |
| 8,157,298 | B2 | 4/2012 | Mitchell et al. | |
| 8,157,299 | B2 | 4/2012 | Mitchell et al. | |
| 9,097,043 | B2 | 8/2015 | Mitchell et al. | |
| 9,650,823 | B2 * | 5/2017 | Svenson | E05D 15/0652 |
| 2004/0135376 | A1 | 7/2004 | Jeffries | |
| 2005/0120631 | A1 | 6/2005 | Sanders | |
| 2005/0193784 | A1 | 9/2005 | Sanders | |
| 2006/0145488 | A1 | 7/2006 | Wittke et al. | |
| 2006/0150517 | A1 * | 7/2006 | Meeks | E05C 1/04 49/368 |
| 2007/0001469 | A1 | 1/2007 | Balbo Di Vinadio | |
| 2007/0029812 | A1 | 2/2007 | Monts de Oca | |
| 2007/0283629 | A1 | 12/2007 | Phipps | |
| 2008/0087052 | A1 | 4/2008 | Abdollahzadeh et al. | |
| 2010/0107503 | A1 | 5/2010 | Chapman | |
| 2010/0212375 | A1 * | 8/2010 | Mitchell | E05B 63/242 70/141 |

OTHER PUBLICATIONS

Official Action of U.S. Appl. No. 12/895,429, dated Oct. 17, 2011, 7 pgs.

Official Action of U.S. Appl. No. 12/895,432, dated Oct. 17, 2011, 8 pgs.

* cited by examiner

PASSIVE DOOR BOLT ASSEMBLY

FIELD OF THE PRESENT DISCLOSURE

The present disclosure relates to bolts, particularly slide bolts, used to secure a passive door of a double door entryway.

BACKGROUND

French door, or double door, entryway units are popular in commercial and residential settings for their pleasing aesthetics and functional practicality. The optional ability to open a secondary (i.e. passive) door panel greatly increases the ability for ingress and egress of persons and household items.

As seen in FIG. 1, a French door entryway 10 traditionally includes a passive door panel 12, and an adjacent active door panel 14. The sets of door panels may swing inwardly (as shown in FIG. 1) into the structure (so-called "inswing" doors), or may swing outwardly from the structure (so-called "outswing" doors). The passive door panel 12 typically includes an astragal 16 mounted along the entire extent of a non-hinged vertical edge (the stile) of the passive door panel. In its most simple form, the astragal 16 may be little more than molding attached to the passive door panel 12 to act as a stop for the active door panel 14. More recently, astragals 16 have taken the form of assemblies mounted to the stile of the passive door panel 12, which have a significant role in the structural and environmental resistance performance of the entryway 10. The astragal 16 has a role in securing the passive door panel 12 in place, and often includes seals to prevent the infiltration of moisture into the building.

To secure the passive door panel 12 in a closed position, the astragal 16 may be provided with hardware 18, such as conventional sliding bolts, adjacent to at least one of a top and a bottom of the passive door panel. The hardware 18 typically engages a frame 19 of the entryway. The frame may have a header 20 spanning the top of the entryway 10 and a threshold 22 (also referred to as a door sill) spanning the bottom of the entryway. Hardware 18 mounted near the top of the passive door panel would extend upward to engage the header 20, and hardware mounted near the bottom of the passive door panel would extend downward to engage the threshold 22.

Improper assembly or installation of an entryway 10 can create conditions where the hardware 18 is prevented from moving into its fully engaged position. This can lead to reduced strength under wind loads and to sub-optimal compression of sealing components. In some existing hardware 18, the pin may be able to retreat from its extended position inadvertently as a result of repeated active door use. This movement can lead to partial or even full disengagement from the frame and reduced sealing performance. Therefore, designers continue to make improvements to the hardware 18 to provide a more secure, robust and consistent device for maintaining the passive door panel 12 in a closed position.

SUMMARY

One embodiment of the present disclosure includes a bolt assembly configured to secure a passive door panel relative to an entryway frame. The bolt assembly comprises an anchoring base configured to be mounted to the passive door panel or an astragal on the passive door panel. The base is configured to be fixed relative to the passive door panel. The base comprises a first side and a second side. The first side is configured to be arranged facing away from a stile of the passive door panel. The second side is configured to be arranged facing toward the passive door panel relative to the stile, and opposite the first side. The base also has at least one column of spaced apart teeth extending from the second side. The column of spaced apart teeth provides notches between the teeth and adjacent to at least one end of the at least one column. The bolt assembly further comprises a bolt configured to slide relative to the base between at least a first position and a second position. The bolt includes a slide having a finger configured to mate into at least one of the notches in the first position and the second position. The bolt also has a pin attached to the slide for movement therewith. The pin is configured to engage the entryway frame when the bolt is in the second position.

Other embodiments of the present disclosure include a bolt assembly configured to secure a passive door panel relative to an entryway frame. The bolt assembly comprises an anchoring base configured to be mounted to the passive door panel or an astragal on the passive door panel. The base is configured to be fixed relative to the passive door panel. The base comprises a pair of columns of teeth, each column comprising a plurality of spaced apart teeth, and notches formed between the plurality of spaced apart teeth and adjacent to at least one end of each column. The bolt assembly also comprises a bolt configured to slide relative to the base between at least a first position and a second position along a direction parallel with each column. The bolt comprises a slide having a finger, the finger having two distal ends, a first distal end mates into notches along a first column of the pair of columns and a second distal end simultaneously mates into notches along a second column of the pair of columns. The bolt also includes a pin attached to the slide for movement therewith, the pin configured to engage the entryway frame when the bolt is in the second position.

Yet other embodiments of the present disclosure include an astragal configured to be mounted to a passive door panel. The astragal comprises an astragal body having a channel running along a length of the astragal body, a first bolt assembly positioned at a lower end of the astragal body, and a second bolt assembly positioned at an upper end of the astragal body. The first bolt assembly comprises an anchoring base fixedly mounted to the astragal body, wherein the anchoring base comprises a pair of columns of teeth, each column of the pair of columns comprising a plurality of spaced apart teeth with notches formed between the spaced apart teeth. The first bolt assembly also includes a bolt configured to slide relative to the astragal body between a retracted position and an extended position. The bolt comprises a pin configured to engage a threshold when the bolt is in the extended position, the pin having a longitudinal axis, and a slide. The slide has a finger at one end of the slide relative to the longitudinal axis, the finger having two distal ends, a first distal end mates with notches along a first column of the pair of columns and a second distal end mates with notches along a second column of the pair of columns. The slide also has a finger pocket to assist with moving the slide relative to the base. The first bolt assembly includes a lock block, the lock block configured to translate relative to the base and the bolt, and a compression spring positioned between the bolt and the lock block. The compression spring biases the slide of the bolt in an inward direction. The second bolt assembly of the astragal also comprises an anchoring body and a bolt like the first bolt assembly. The second bolt assembly further comprises a guide block fixedly mounted adjacent to the top end of the astragal body, the guide block having a passage through which the pin is configured to slidably extend.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
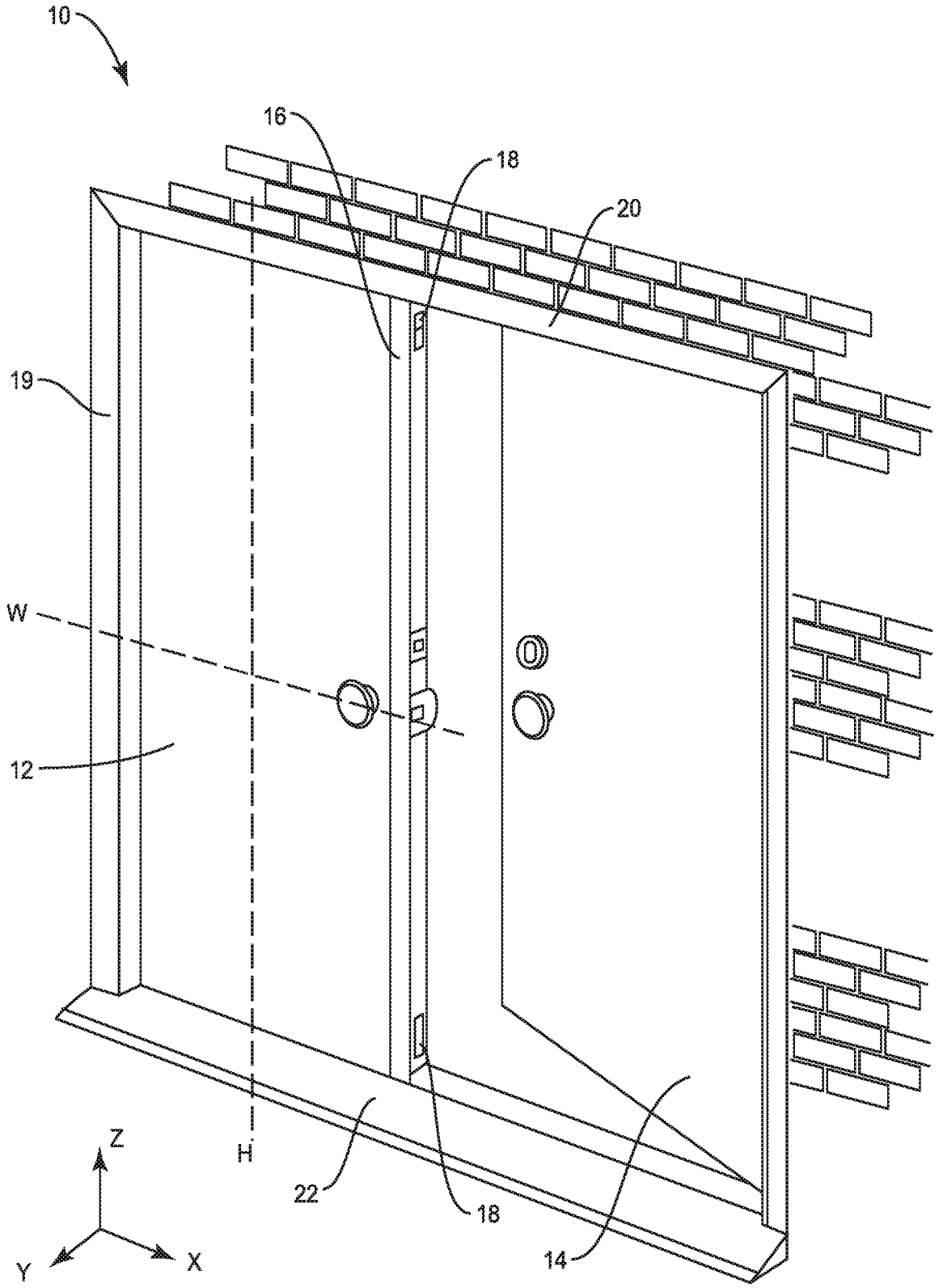
FIG. 1 PRIOR ART
FIG. 1 is an elevation view of a typical French door entryway.

As used herein, the passive door panel 12, is defined to include a height axis H and a width axis W that each bisect the major plane of the passive door panel 12 as shown in FIG. 1. As used herein, components configured to "extend" and "retract" are intended to do so in a direction substantially parallel with the height axis H. A retracted position is defined in part as a state relatively closer to the width axis W than a corresponding extended position. Similarly, the relative terms "inner" and "inward" suggest locations closer to or relatively toward the width axis W as compared to corresponding "outer" and "outward" locations or elements. Further, the relative terms "front" and "rear" are used in the present disclosure to define relative positions along a direction parallel with the width axis W. A rear portion is intended to be closer to the height axis H than a front portion, when the corresponding component is in use.

Figure 2:
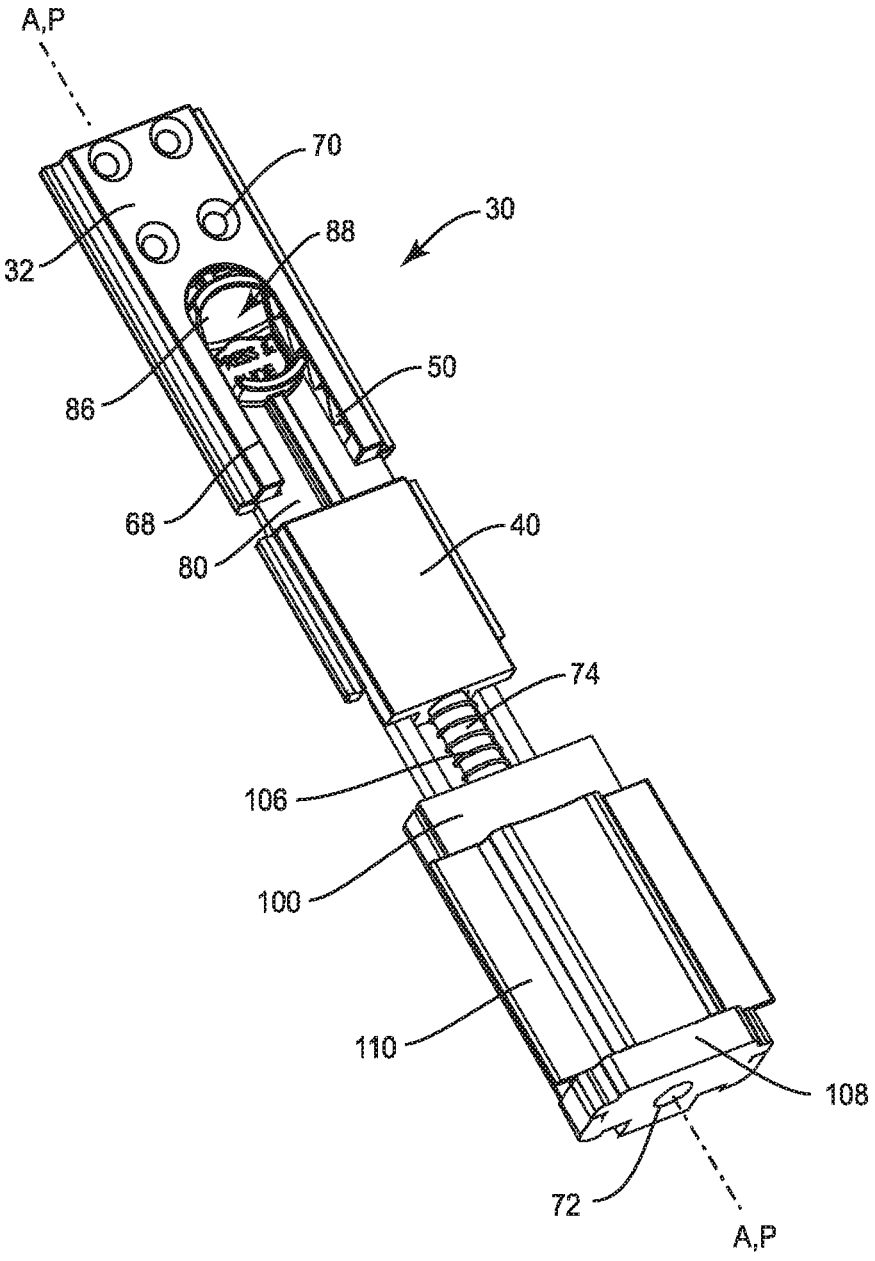
FIG. 2 is a front perspective of a bolt assembly according to embodiments of the present disclosure.
Figure 3:
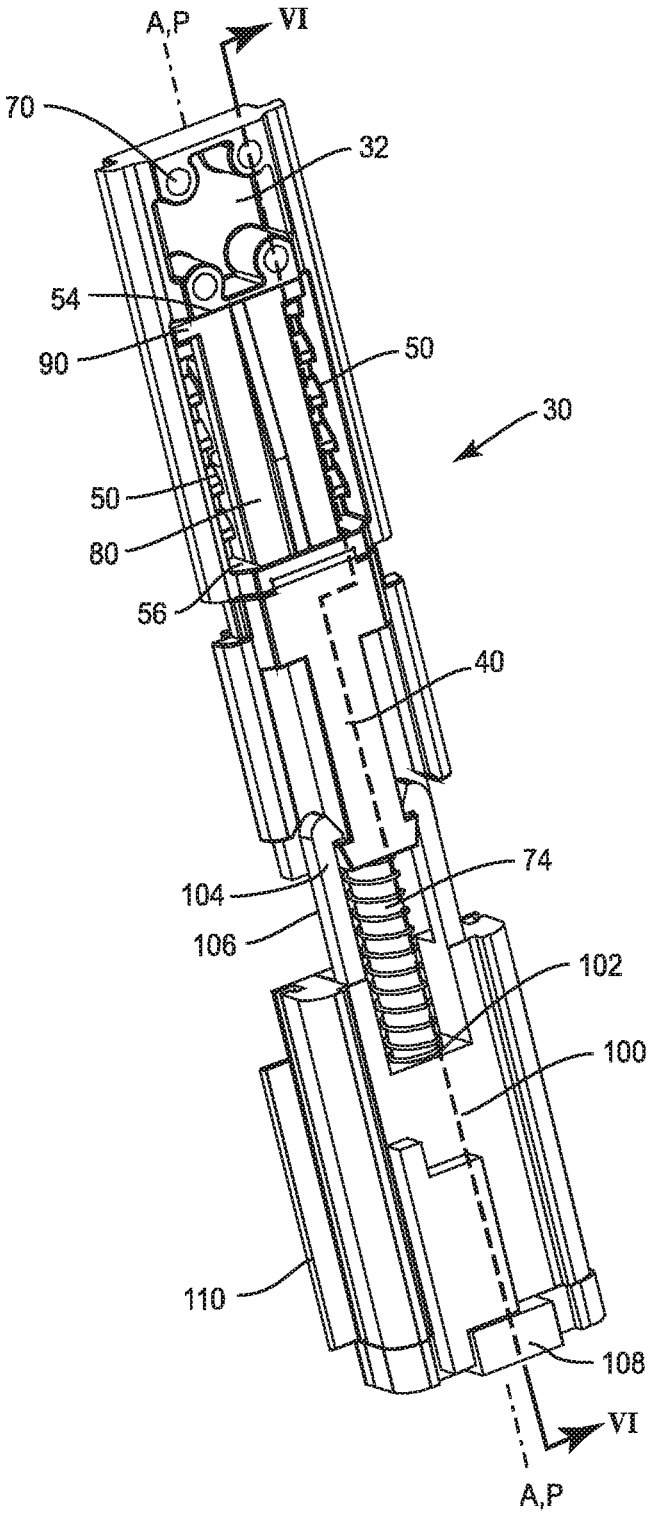
FIG. 3 is a rear perspective of the bolt assembly of FIG. 2.

Turning to FIGS. 2 and 3, front and rear perspective views of a bolt assembly 30 are provided. The bolt assembly 30 includes an anchoring base 32, hereafter base 32. In one embodiment, the base 32 is used to mount the bolt assembly 30 to a passive door panel 12. For example, a mortis may be provided on the free stile of the passive door panel 12 to receive the bolt assembly 30. In a preferred embodiment, the bolt assembly 30 is combined into an astragal assembly as discussed below and shown in FIG. 7. In this embodiment, the base 32 may be used to securely position the bolt assembly 30 as part of the astragal. The base 32 would be fixedly mounted relative to the passive door panel 12 to swing with the passive door panel and avoid relative movement between the passive door panel and the base.

Figure 4:
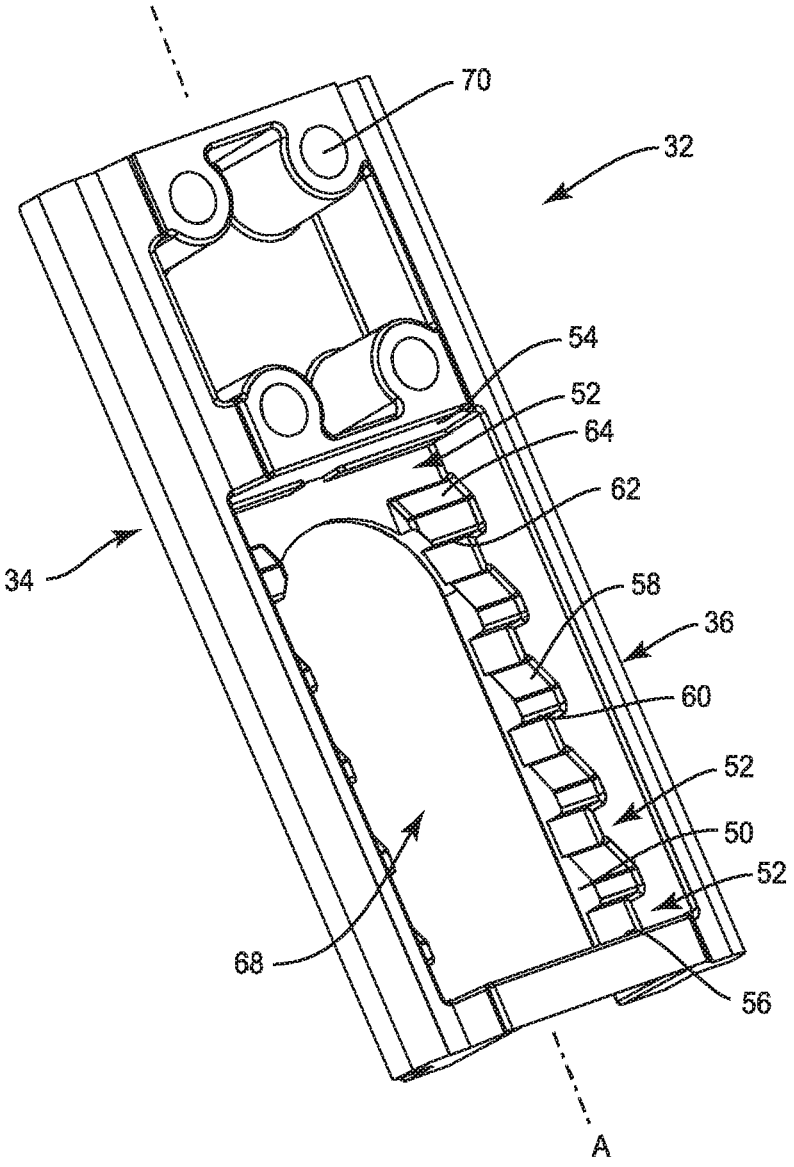
FIG. 4 is a rear perspective view of an anchoring base of the bolt assembly of FIG. 2.

FIG. 4 shows a rear perspective view of the base 32 according to one embodiment. The base 32 includes a front side 34 and a rear side 36. The front side 34 is expected to be facing away from the stile of the passive door panel 12 when the base is installed, and the rear side 36 is expected to be facing toward the passive door panel. Therefore the front side 34 and rear side 36 are opposite one another. A longitudinal axis A extends along the longest dimension of the base 32. When mounted relative to the passive door panel 12, the longitudinal axis A would be expected to be parallel with the height axis H of the passive door panel.

The base 32 is used to position and slidably secure a bolt 40 relative to the passive door panel 12. To facilitate this functionality, the base 32, for example the rear side 36, includes a plurality of spaced apart teeth 50 extending from the rear side. The spaces that result between each of the plurality of spaced apart teeth may be referred as notches 52. Additional notches 52 may be located between an inwardmost tooth 50 and an inward stop wall 54, and between an outwardmost tooth 50 and an outward stop wall 56 of the base 32. One or more of the teeth 50 may include an inward portion 58 configured to be located toward a center of the passive door panel 12 along a height thereof when the base 32 is mounted relative to the passive door panel. Similarly, one or more of the teeth 50 may include an outward portion 60 configured to be located toward an end of the passive door panel 12 along the height thereof relative to the inward portion 58 when the base 32 is mounted relative to the passive door panel. The system of teeth 50 and notches 52 may be referred to as a ratchet system.

The outward portion 60 of each tooth 50 may be configured to limit inadvertent motion of the bolt 40 toward a retracted position. For example, the outward portion 60 may include an abutment surface 62 arranged normal to the longitudinal axis A of the base 32. The inward portion 58 of each tooth 50, on the other hand, may be configured to assist with sliding the bolt 40 toward an extended position. Therefore, for example, the inward portion 58 may include a ramp surface 64 oblique relative to the longitudinal axis A of the base 32.

The base 32 includes a cut-out 68 providing access to the bolt 40. The cut-out 68 may help guide a portion of the bolt 40 during sliding from a retracted position to an extended position and vice versa. The cut-out 68 may be centrally located along the width of the base 32. When mounted relative to the passive door panel 12, the width of the base 32 may correspond with the interior/exterior direction of the entryway 10 as shown by axis Y in FIG. 1.

As possibly best seen in FIG. 4, the plurality of teeth 50 may be arranged in a pair of columns running generally parallel with the longitudinal axis A. The pair of columns may be arranged along opposite sides of the cut-out 68.

The base 32 may provide a plurality of fastener apertures 70 for accepting fasteners. The fasteners, including but not limited to screws or bolts, fixedly mount the base 32 relative to the passive door panel 12.

Returning briefly to FIGS. 2 and 3, the bolt assembly 30 also includes the bolt 40 as mentioned above. The bolt 40 is configured to selectively translate relative to the base 32 to extend and retract the bolt relative to the top or bottom of the passive door panel 12. As commonly understood in the art of shoot bolt hardware, a most retracted position includes an engagement end 72 of the bolt 40 positioned substantially at or inward of a respective top or bottom edge of the passive door panel 12. An extended position, on the other hand, involves the engagement end 72 of the bolt 40 extending outward beyond the respective upper or lower edge of the passive door panel 12 into engagement with a header 20 or a threshold 22 respectively.

Figure 5:
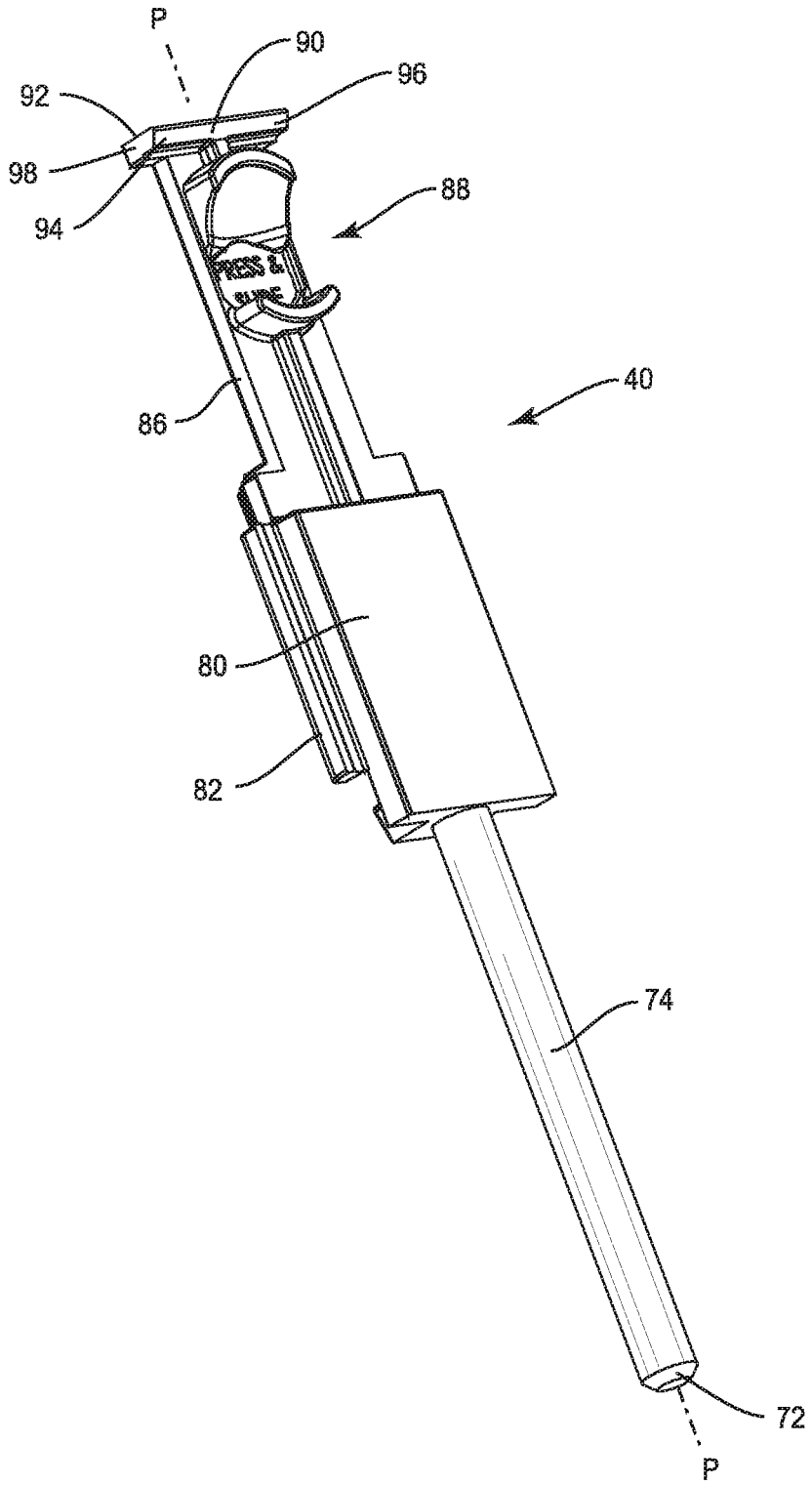
FIG. 5 is a detailed front view of the bolt of the bolt assembly of FIG. 2.

FIG. 5 shows a front perspective view of the bolt 40. The engagement end 72 may be defined by a pin 74. The pin 74 has a longitudinal pin axis P which will be substantially parallel with the longitudinal axis A of the base 32 when the bolt assembly 30 is assembled. The pin 74 is preferably a strong metal, such as steel, to provide strength while the pin is engaged with the entryway 10.

In the illustrated embodiment, a slide 80, formed from a polymer, is over-molded onto the pin 74. In other embodiments, the pin 74 and the slide 80 may be formed as a unitary, integral component formed from metal or plastic, or as a multi-piece assembly. In some embodiments, one or more flanges 82 may be provided along the length of the slide 80. The flanges 82 extend perpendicular to the longitudinal pin axis P. The flanges 82 can help position and retain the slide 80 within an astragal as discussed below. The flanges 82 may be continuous along some or all of the length of the slide 80. Alternatively, the flanges 82 may be provided as various segments along the slide 80.

In the illustrated embodiment, the bolt 40 also includes an interface 86 located on an opposite end of the slide 80 from the pin 74. The interface 86 is accessed by a user to manually translate the bolt 40 from an extended position to a retracted position and vice versa. Various structures may be provided to assist the user with gripping and translating the bolt 40. Projections may act as handles. Alternatively, grooves, apertures, or a pocket 88 may be configured to assist with manipulation of the bolt 40 with the user's finger(s).

The slide 80 is formed with a positioning finger 90, hereafter simply finger 90 configured to selectively mate into the notches 52, between and adjacent to the plurality of spaced apart teeth 50, to position the bolt 40 relative to the base 32. In the illustrated embodiment of FIG. 5, the finger 90 is formed at an inward location relative to the interface 86. An inward facing surface 92 of the finger 90 may be substantially normal to the pin longitudinal axis P. Therefore the inward facing surface 92 would be generally parallel with the abutment surface 62 of each tooth 50. These parallel contacting surfaces, each normal to the extension/retraction direction of the bolt 40 can help retain the bolt relative to the base 32 and limit inadvertent inward motion of the bolt.

To assist with outward motion of the bolt 40, the finger 90 may include a tapered portion 94 on an outward region of the finger. The combination of the tapered portion 94 of the finger 90 and the ramp surface 64 on the inward portion 58 of each tooth 50 promotes sliding of the bolt 40 outward relative to the base 32.

The illustrated finger 90 may be described as having two distal ends 96 and 98. The first distal end 96 can mate within the notches 52 along of a first column of teeth 50 and the second distal end 98 may simultaneously mate within the notches 52 along a second column of teeth 50.

Figure 6A:
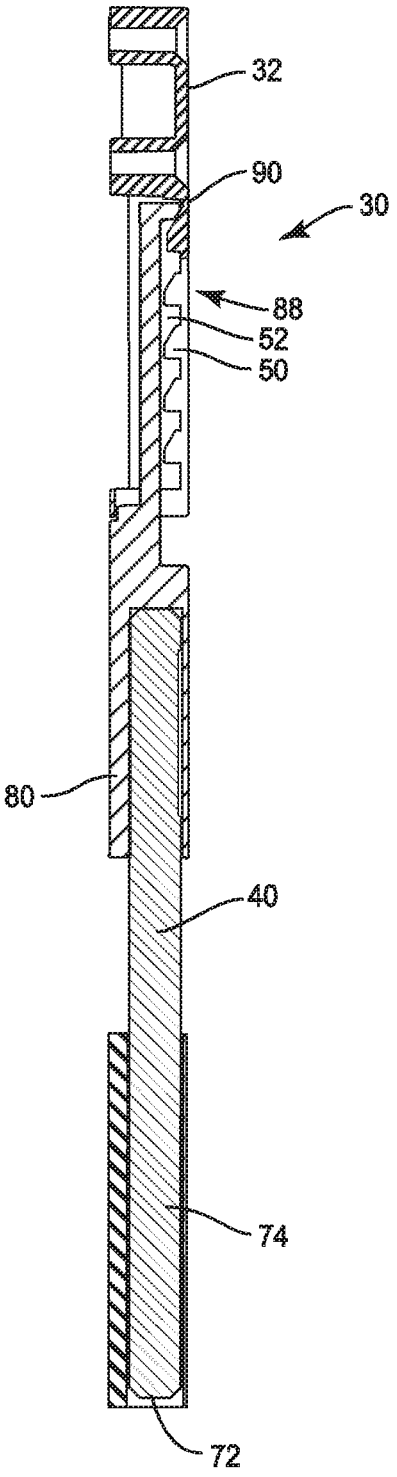
FIG. 6A is a cross section of the bolt assembly in a retracted position at line VI-VI in FIG. 3.
Figure 6B:
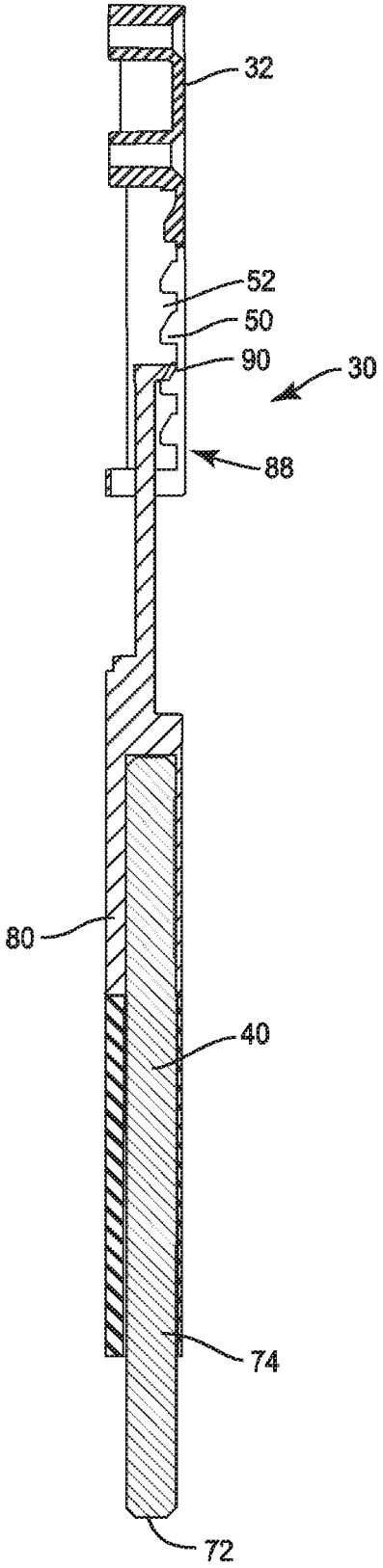
FIG. 6B is a cross section of the bolt assembly in an extended position.

The engagement between the base 32 and the bolt 40 in a most retracted and a most extended position may be best understood from the cross sections of FIGS. 6A and 6B respectively. The plurality of teeth 50, and therefore the plurality of notches 52, provide for a discrete number of additional retention positions along the extension/retraction direction of the bolt assembly 30. These additional retention positions are provided to accommodate variance in the spacing between the bottom of the astragal and the sill or header.

In the most retracted position shown in FIG. 6A, the finger 90 at least partially resides within an inwardmost notch 52. To transition the bolt 40 toward the most extended position shown in FIG. 6B, a user may press the pocket 88 rearward while substantially simultaneously translating the slide 80 outward. This process of pressing the pocket 88 rearward may be combined with translating the slide 80 inward to return from an extended position to a retracted position. Pressing the pocket 88 rearward may result in the slide being temporarily bent relative to the longitudinal pin axis P to remove the finger 90 from an initial notch 52.

Returning to FIGS. 2 and 3, the illustrated bolt assembly 30 includes an optional lock block 100. The lock block 100 includes a central passage 102 (see FIG. 3) through which the pin 74 extends. The lock block 100 may also include at least one leg 104 for attachment of the lock block 100 to the slide 80. The lock block 100 is configured to be able to translate relative to the bolt 40 and the base 32. In other words, the pin 74 is configured to slide relative to the central passage 102, and the lock block 100 is not fixedly mounted relative to the passive door panel 12.

A compression spring 106 is positioned between the slide 80 and the lock block 100. The compression spring 106 may be provided around a portion of the pin 74. The compression spring 106 seeks to force the lock block 100 toward the engagement end 72 of the bolt 40. When the bolt 40 is translated toward an extended position, the lock block 100 is similarly urged outward. Contact between the lock block 100 and the threshold 22 may cause shortening of the compression spring 106. A bottom sealing pad 108 may be carried on the bottom of the lock block 100 and configured to help seal the lock block against the threshold 22. An optional corner sealing pad 110 may also be provided on and carried with the lock block 100 for sealing against the stile of the active door panel 14. In addition, an optional back sealing pad (not shown) may be provided on and carried with the lock block 100 on a face of the lock block opposite the corner sealing pad 110. When provided, the back sealing pad helps seal between the lock block 100 and an edge of the passive door panel by residing in an opening in the astragal body.

The compression spring 106 biases the lock block 100 and the slide 80 in opposite directions. Therefore, while the lock block 100 is biased outward, the slide 80 is biased inward. The inward biasing of the slide 80 provided by the compression spring 106 urges contact between the inward facing surface 92 of the finger 90 and the abutment surface 62 of a respective tooth 50, helping to secure the bolt 40 in its current position of extension.

Figure 7:
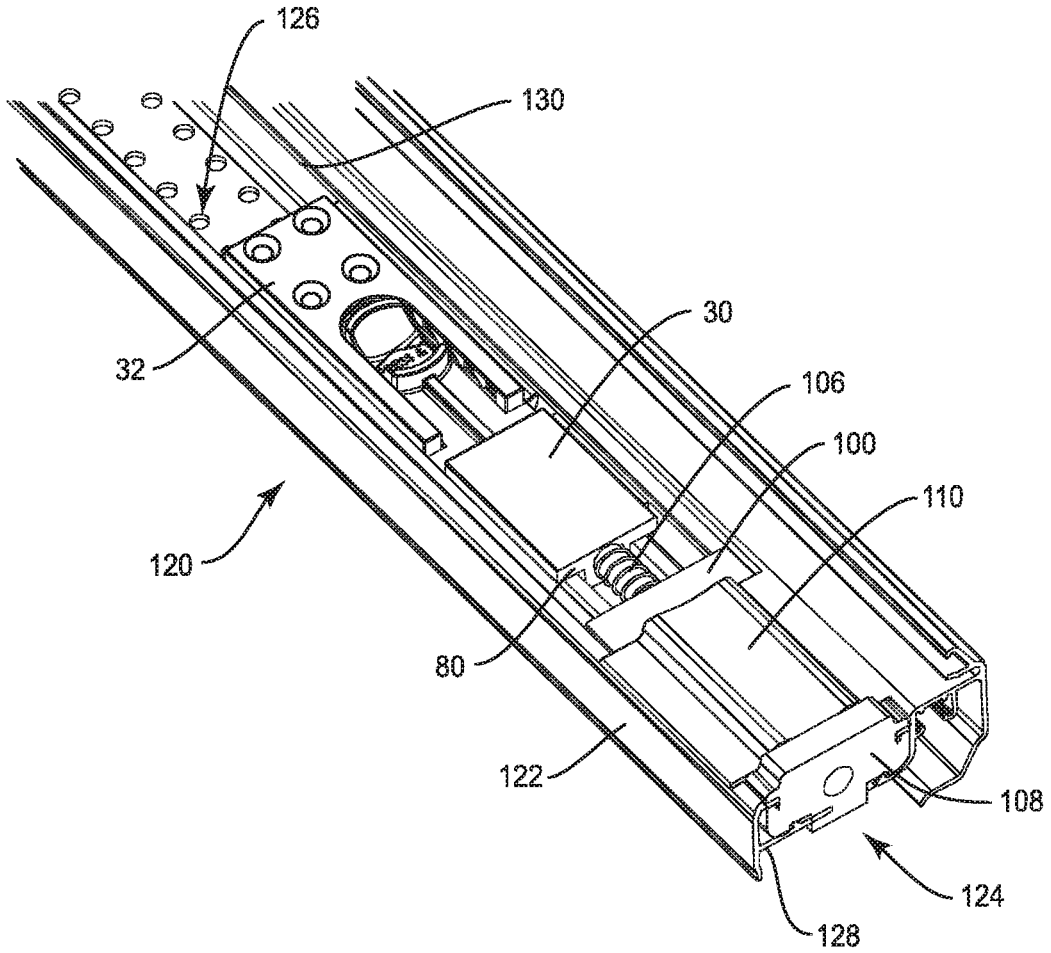
FIG. 7 is a perspective of the lower end of an astragal assembly having a bolt assembly according to an embodiment of the present disclosure.

Turning to FIG. 7, a bottom perspective view is provided that shows the bolt assembly 30 mounted at the lower end of an astragal assembly 120. The astragal assembly 120 includes an astragal body 122. The astragal body 122 may be an extrusion, such as an aluminum extrusion. The astragal body 122 provides a mounting side 124 for attachment to the stile of the passive door panel 12 and a front side 126 configured to face the free stile of the active door panel 14 when the active door panel is closed.

The astragal body 122 defines a channel 128 running along a length of the astragal body. The length of the astragal body 122 is parallel with the height axis H of the passive door panel 12 when the astragal assembly 120 is attached to the passive door panel. FIG. 7 shows the bolt assembly 30 mounted at least partially within the channel 128. The bolt assembly 30 may be assembled along the channel 128 by insertion into one of the ends of the astragal body 122. In another embodiment, the bolt assembly 30 is sized and shaped such that the bolt assembly can rotate into the channel 128 at the desired location through the gap 130 in the face of the channel 128.

Figure 8:
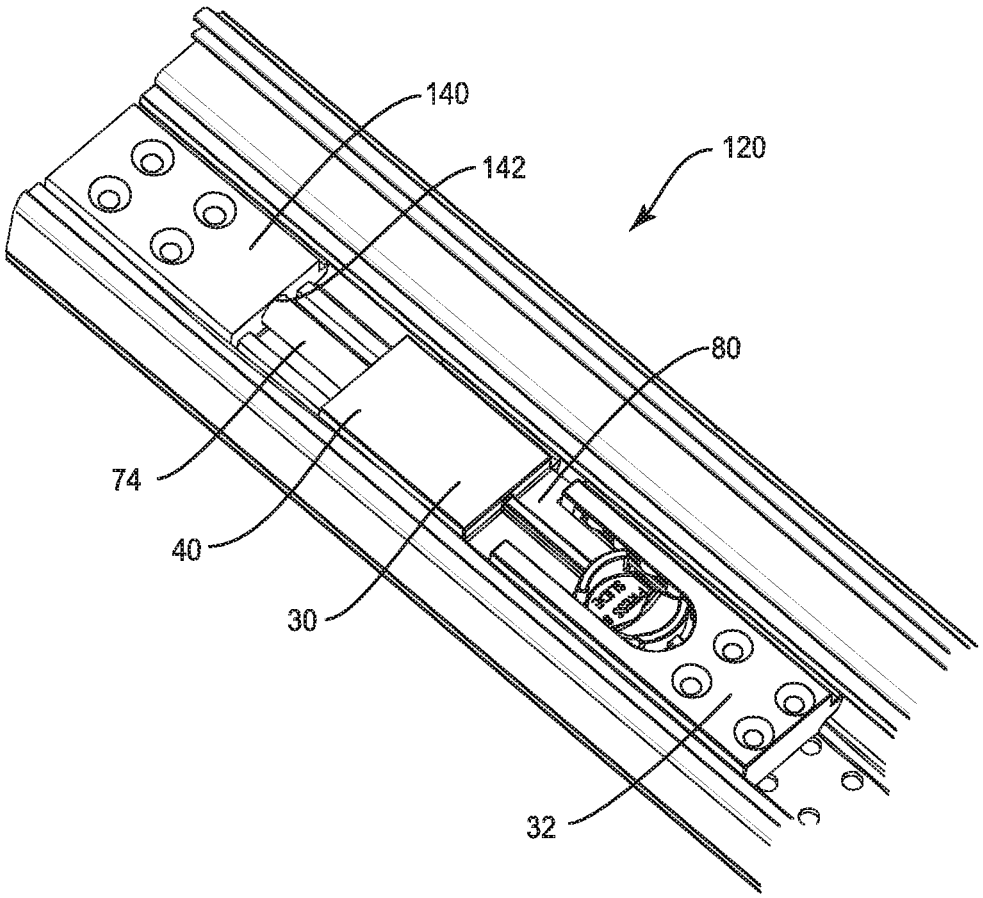
FIG. 8 is a perspective of the upper end of an astragal assembly having a bolt assembly according to an embodiment of the present disclosure.

FIG. 8 shows the top end of the astragal assembly 120. The bolt assembly 30 at the top end of the astragal assembly 120 is optionally provided with a guide block 140. The guide block 140 includes a guide passage 142 through which the pin 74 is configured to slidably extend as the bolt 40 is translated between a retracted position and an extended position thereof. Unlike the lock block 100 used at the bottom end of the astragal body 122, the guide block 140 is configured to be fixed within the channel 128. Therefore, the guide block 140 guides and stabilizes the pin 74, but the guide block 140 does not extend from the top end of the astragal body 122. The guide block 140 will generally not include the sealing pads 108, 110 used with the lock block 100. Sealing requirements at the top of an entryway 10 are generally less critical than at the bottom because the top is less susceptible to penetration by wind-blown water. Therefore, the sealing benefits of the lock block 100 may be less necessary at the top of the astragal assembly 120, therefore promoting use of the guide block 140. The guide block 140 may also be provided without the compression spring 106 engagement with the slide 80. Gravity may be sufficient to bias the slide 80, which is mounted at the top end of astragal body 122, toward the inward direction, providing the desired contact between the inward facing surface 92 of the finger 90 and the abutment surface 62 of a tooth 50. Therefore use of the guide block 140 may reduce assembly time and component costs relative to using a lock block 100 on both the top and bottom of the astragal assembly 120.

One or more trim covers (not shown) may be mounted to the astragal body 122 to at least partially enclose the channel 128. The trim cover may be provided with an opening for providing access to the pocket 88 of the slide 80.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A bolt assembly configured to secure a passive door panel relative to an entryway frame, the bolt assembly comprising:

an anchoring base configured to be mounted to the passive door panel or an astragal on the passive door panel, the base is configured to be fixed relative to the passive door panel, wherein when the base is mounted to the passive door panel or astragal the base comprises:

a first side and a second side, the first side configured to be arranged facing away from a stile of the passive door panel, the second side is configured to be arranged facing toward the passive door panel relative to the stile, and opposite the first side; and at least one column of spaced apart teeth, each of the teeth of the at least one column of teeth extending from the second side in a direction away from the first side, the column of spaced apart teeth providing notches between the teeth, and the notches provided adjacent to at least one end of the at least one column; and a bolt configured to slide relative to the base between at least a first position and a second position, the bolt comprising:

a slide having a finger configured to mate into at least one of the notches in the first position and the second position; and a pin attached to the slide for movement therewith, the pin configured to engage the entryway frame when the bolt is in the second position.

2. The bolt assembly of claim 1, wherein the slide further comprises a finger pocket to assist with moving the slide relative to the base between the first position and the second position.

3. The bolt assembly of claim 1, wherein the pin defines a longitudinal axis, and the at least one column of spaced apart teeth is arranged parallel with the longitudinal axis.

4. The bolt assembly of claim 1, wherein at least some of the spaced apart teeth comprise:

an inward portion configured to be located toward a center of the passive door panel along a height thereof;

an outward portion configured to be located toward an end of the passive door panel along the height thereof; and wherein the outward portion of each tooth comprises an abutment surface perpendicular to a longitudinal axis of the base.

5. The bolt assembly of claim 1, wherein at least some of the spaced apart teeth comprise:

an inward portion configured to be located toward a center of the passive door panel along a height thereof;

an outward portion configured to be located toward an end of the passive door panel along the height thereof; and wherein the inward portion of each tooth comprises a ramp surface oblique relative a longitudinal axis of the base.

6. The bolt assembly of claim 1, wherein the finger is formed on an inner end of the slide.

7. The bolt assembly of claim 6, wherein the slide is temporarily bent to remove the finger from an initial one of the notches.

8. The bolt assembly of claim 6, wherein an inner facing surface of the finger is substantially normal to a longitudinal axis of the pin.

9. The bolt assembly of claim 1, wherein the finger includes a tapered portion.

10. The bolt assembly of claim 1, wherein the slide is over-molded onto the pin.

11. The bolt assembly of claim 1, further comprising a lock block, the lock block configured to translate relative to the base and the bolt.

12. The bolt assembly of claim 11, further comprising one or more sealing pads attached to the lock block.

13. The bolt assembly of claim 11, further comprising a compression spring positioned between the bolt and the lock block, wherein the compression spring biases the slide in an inward direction and the lock block in an outward direction.

14. An astragal configured to be mounted to a passive door panel, the astragal comprising:

an astragal body having a channel running along a length of the astragal body; and a bolt assembly according to claim 1 mounted to the astragal body at least partially within the channel.

15. The astragal of claim 14, wherein the bolt assembly rotationally enters into the astragal body.

16. The bolt assembly of claim 1, wherein the finger is configured to move in a direction away from the first side to slide the bolt between the first position and the second position.

17. A bolt assembly configured to secure a passive door panel relative to an entryway frame, the bolt assembly comprising:

an anchoring base configured to be mounted to the passive door panel or an astragal on the passive door panel, the base is configured to be fixed relative to the passive door panel, wherein the base comprises a pair of columns of teeth, each column comprising a plurality of spaced apart teeth, and notches formed between the plurality of spaced apart teeth and the notches provided adjacent to at least one end of each column, such that when the base is mounted to the passive door panel or astragal, each of the teeth of the pair of columns of teeth are configured to extend in a direction perpendicular to a vertical edge of the passive door panel and away from the passive door panel; and a bolt configured to slide relative to the base between at least a first position and a second position along a direction parallel with each column, the bolt comprising:

a slide having a finger, the finger having two distal ends, a first distal end mates into notches along a first column of the pair of columns and a second distal end simultaneously mates into notches along a second column of the pair of columns; and a pin attached to the slide for movement therewith, the pin configured to engage the entryway frame when the bolt is in the second position.

18. The bolt assembly of claim 17, further comprising a lock block, the lock block configured to translate relative to the base and the bolt.

19. The bolt assembly of claim 18, further comprising one or more sealing pads attached to the lock block.

20. The bolt assembly of claim 18, further comprising a compression spring positioned between the bolt and the lock block, wherein the compression spring biases the slide in an inward direction.

21. An astragal configured to be mounted to a passive door panel, the astragal comprising:

an astragal body having a channel running along a length of the astragal body; and a first bolt assembly positioned at a lower end of the astragal body, the first bolt assembly comprising:

an anchoring base fixedly mounted to the astragal body, wherein the anchoring base comprises a pair of columns of teeth, each column of the pair of columns comprising a plurality of spaced apart teeth with notches formed between the spaced apart teeth, the pair of columns of teeth configured to extend in a direction perpendicular to a vertical edge of the passive door panel;

a bolt configured to slide relative to the astragal body between a retracted position and an extended position, the bolt comprising:

a pin configured to engage a threshold when the bolt is in the extended position, the pin having a longitudinal axis; and a slide, comprising:

a finger at one end of the slide relative to the longitudinal axis, the finger having two distal ends, a first distal end mates with notches along a first column of the pair of columns and a second distal end mates with notches along a second column of the pair of columns; and a finger pocket to assist with moving the slide relative to the base;

a lock block, the lock block configured to translate relative to the base and the bolt; and a compression spring positioned between the bolt and the lock block, wherein the compression spring biases the slide in an inward direction; and a second bolt assembly positioned at an upper end of the astragal body, the second bolt assembly comprising:

an anchoring base fixedly mounted to the astragal body, wherein the anchoring base comprises a pair of columns of teeth, each column of the pair of columns comprising a plurality of spaced apart teeth with notches formed between the spaced apart teeth;

a bolt configured to slide relative to the astragal body between a retracted position and an extended position, the bolt comprising:

a pin configured to engage a threshold when the bolt is in the extended position, the pin having a longitudinal axis; and a slide, comprising:

a finger at one end of the slide relative to the longitudinal axis, the finger having two distal ends, a first distal end mates with notches along a first column of the pair of columns and a second distal end mates with notches along a second column of the pair of columns; and a finger pocket to assist with moving the slide relative to the anchoring base; and a guide block fixedly mounted adjacent to the top end of the astragal body, the guide block having a passage through which the pin is configured to slidably extend.

* * * * *